United States Patent [19]

Schmidt et al.

[11] 4,180,947

[45] Jan. 1, 1980

[54] GRINDING METHOD

[75] Inventors: Dieter H. Schmidt, Terrace Park; Dean H. Garman, Cincinnati, both of Ohio

[73] Assignee: Cincinnati Milacron Inc., Cincinnati, Ohio

[21] Appl. No.: 868,108

[22] Filed: Jan. 9, 1978

[51] Int. Cl.[2] ..... B24B 1/00; B24B 5/14

[52] U.S. Cl. ..... 51/326; 51/105 SP; 51/237 R; 51/238 S; 51/327

[58] Field of Search ..... 51/217 T, 237 R, 326, 51/327, DIG. 15, 238 R, 238 S, 105 SP, 216 T, 105 R

[56] References Cited

U.S. PATENT DOCUMENTS

| | | | |
|---|---|---|---|
| 667,230 | 2/1901 | Landis | 51/217 T X |
| 869,194 | 10/1907 | Norton | 51/237 R X |
| 1,860,796 | 5/1932 | Yerk | 51/238 R |
| 1,993,064 | 3/1935 | LeBlanc | 51/237 R X |
| 2,190,134 | 2/1940 | Garside | 51/237 R |
| 3,145,507 | 8/1964 | Price | 51/237 R X |
| 4,019,288 | 4/1977 | Moritomo | 51/327 |

FOREIGN PATENT DOCUMENTS

| | | | |
|---|---|---|---|
| 1164871 | 3/1964 | Fed. Rep. of Germany | 51/238 S |
| 385656 | 3/1965 | Switzerland | 51/237 R |

*Primary Examiner*—Gary L. Smith
*Attorney, Agent, or Firm*—Thomas M. Farrell

[57] ABSTRACT

A vehicle rear axle housing has opposite end grind diameters and inboard tooling diameters proximate to the grind diameters. The grind diameters are ground on a centertype grinder by supporting the ends of the housing in both axial and radial directions; supporting the inboard tooling diameters with a floating support means; rotating the housing from one end; and grinding one of the end grind diameters with a rotating grinding wheel. The floating support means acting on each of the inboard tooling diameters opposes the tendency of the housing to sag during the grinding process.

6 Claims, 5 Drawing Figures

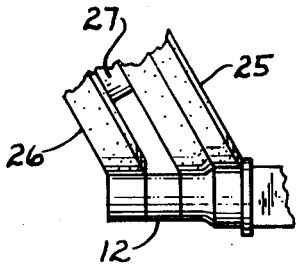
Fig. 2
Fig. 3
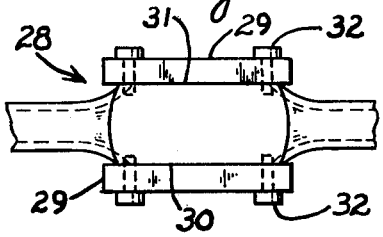
PRIOR ART
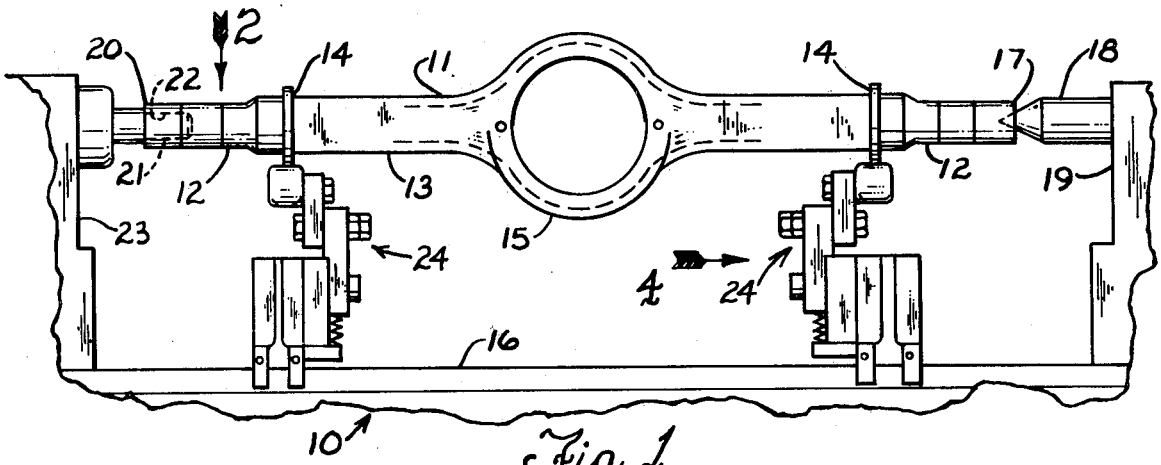
Fig. 1
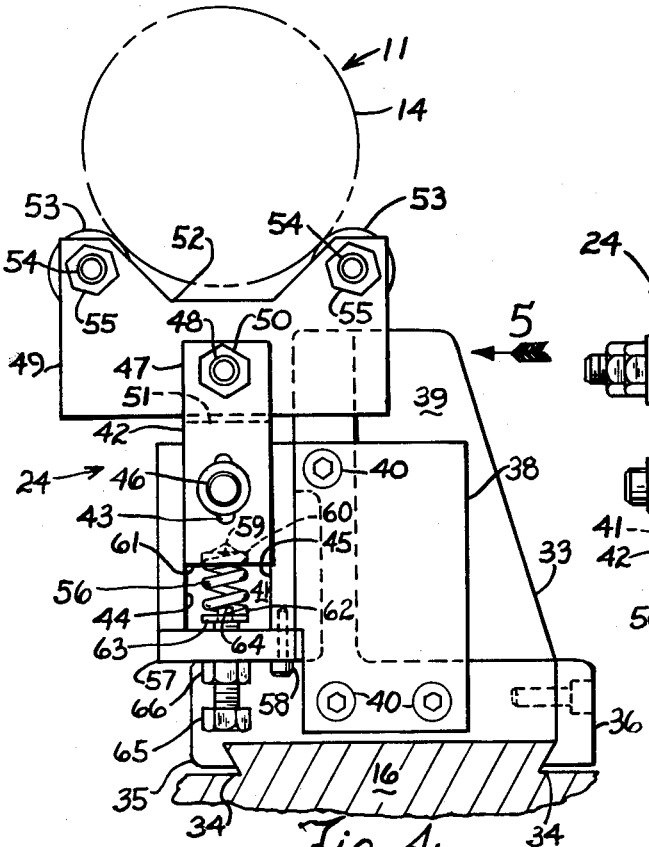
Fig. 4
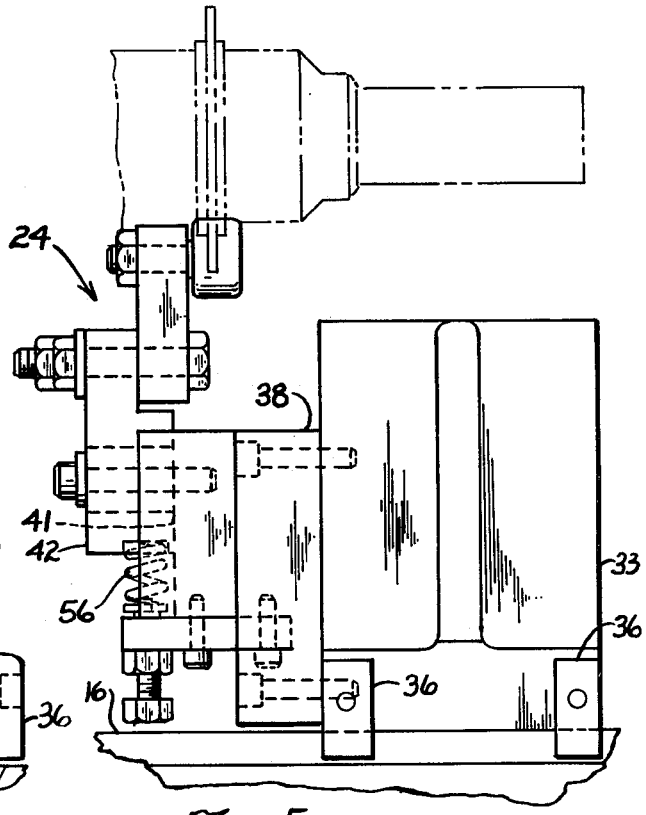
Fig. 5

GRINDING METHOD

This application is a Substitute for abandoned application for Grinding method, Ser. No. 788,280, filed Apr. 18, 1977.

BACKGROUND OF THE INVENTION

A common part encountered when machining automotive-type workpieces is the vehicle rear axle housing, or "banjo housing". The housing is generally tubular in shape having a bulged portion centrally located along the tubular central axis, wherein the bulged portion consists of a spherical shape which is truncated by two planes parallel to the tubular axis. The housing is hollow and has one or more grind diameters at each end, together with a flange diameter which is located inboard from the end, proximate to the grind diameters, for mounting stationary brake assemblies, etc. When attempting to machine the requisite grind diameters of one end, the workpiece is generally held between centers in a headstock and footstock respectively, and is rotated during the grind process. When viewed along a horizontal plane through the tubular central axis, the housing will sag due to its weight and the simply-supported arrangement, as expected. However, the truncated spherical section has a section modulus which varies from stiffest to weakest along axes at 90° to each other. Therefore, the sag of the housing is not constant through a rotation, but varies in cyclical fashion every one-quarter turn of the housing, wherein the sag goes from a minimum to a maximum position. The cyclical variances tend to cause instability and out-of-roundness control problems at the grind point on the grind diameters.

A prior art method has been attempted, with some success, to alleviate the variable sag phenomenon encountered, wherein the truncated planes of the housing have weighted blocks, or braces, bolted to the planes so as to stiffen the weakest section modulus and thus approach a substantially constant sag form. The difficulties inherent in this prior art method lies in the fact that the housings must be handled repeatedly in applying and removing the braces before and after grinding respectively, and unique tooling must be made for each housing shape.

Applicant has obviated the problems inherent in the prior art device by a novel grinding method wherein no braces need to be applied to the housing. Rather, unique floating supports, consisting in part of spring-loaded rollers, are urged against the inboard flanges or "tooling diameters", in a direction opposing sag tendencies during the grinding process.

It is therefore an object of the present invention to provide a grinding method for rear axle housings which insures relatively simple part handling procedures.

It is another object of the present invention to provide a dynamic, tunable floating support for rear axle housing during a grinding process.

Still another object of the present invention is to provide a relatively universal floating support capable of being applied to a variety of rear axle housings during a grinding process.

SUMMARY OF THE INVENTION

The invention is shown embodied in a method for grinding the end grind diameters of a vehicle rear axle housing having a generally tubular form with an enlarged truncated spherical segment midway along the central axis and inboard end tooling diameters proximate to the grind diameters, wherein a cylindrical center-type grinder is used to support, drive and grind the housing. The method comprises the following steps in combination; (a) supporting the ends of said housing in both axial and radial directions by end support means; (b) supporting said inboard tooling diameters with floating support means; (c) rotating said housing from one end by driving means; and (d) grinding one of said opposite end grind diameters with a rotating grinding wheel.

The housing is reversed end-for-end on said floating support means and similar steps are repeated to grind the other of the opposite end grind diameters.

BRIEF DESCRIPTION OF THE DRAWINGS

FIG. 1 is a front elevational view of a grinding machine adapted to support and drive a rear axle housing when grinding.

FIG. 2 is plan view taken in the direction of arrow 2 of FIG. 1, showing grinding wheels in contact with end grind diameters of a rear axle housing.

FIG. 3 is an elevational view of a prior art device for bracing a truncated spherical section of a rear axle housing.

FIG. 4 is an elevational view taken in the direction of arrow 4 of FIG. 1, illustrating a floating support for a rear axle housing.

FIG. 5 is an elevational view of the floating support taken in the direction of arrow 5 of FIG. 4.

DESCRIPTION OF THE PREFERRED EMBODIMENT

Referring to FIG. 1, there is shown a grinding machine 10 for supporting and driving a vehicle rear axle housing 11. The housing 11 has grind diameters 12 at each end of a generally tubular body 13 and flanges, or "inboard tooling diameters" 14, are located along the tubular body 13 proximal to the end grind diameters 12. An enlarged truncated spherical section 15 is located midway along the axis of the housing 11, and, since the housing 11 is hollow, the housing 11 has differing section moduli at the midspan point, such that the axle housing 11 will tend to sag under the influence of gravity relative to the machine table 16, but the sag will not be constant as the housing 11 is rotated. One end 17 of the housing 11 is supported in axial and radial directions by the center 18 of a footstock 19 in a manner well-known in the art, and the other end 20 of the housing 11 is supported in axial and radial directions by a chuck mandrel 21 which engages with the inner diameter 22 of the housing 11. The chuck mandrel 21 is adapted to a machine headstock 23 to provide a rotational drive to the housing 11 when grinding. A pair of floating supports 24 are adapted to the machine table 16, and provide support to the inboard tooling diameters 14 of the housing 11 to counteract sag tendencies.

The plan view of FIG. 2 depicts two grinding wheels 25,26 having a spacer 27 therebetween, adapted to grind a plurality of grind diameters 12 at the end 20 of the housing 11. The housing 11 is reversed, end-for-end, on the floating supports 24, to grind the opposite end.

It is preferable to perform rough grinding cuts at a first rotational speed of the housing 11, and to perform subsequent, finish grinding cuts at a second, slower rotational speed.

FIG. 3 depicts a prior art device 28 for counteracting the sag tendencies due to varying section moduli. The truncated spherical section 15 has braces 29 bolted to the truncation planes 30,31 so as to stiffen the housing 11 at its weakest flexural point. The braces 29 are secured to the housing 11 by screws 32, and the braces 29 and screws 32 must be added and removed before and after the grinding operations respectively, thus increasing the handling time and complicating the grinding operation.

The elevational view of FIG. 4 illustrates the floating support 24 as it is adapted to support a tooling diameter 14 on the housing 11. A base bracket 33 is adapted to rest on the machine table 16 and is clamped to the machine dovetail ways 34 by an integral dovetail portion 35 and a dovetail clamp 36 which is secured to the bracket 33 by a screw 37. The base bracket 33 extends vertically from the table 16 and has a carrier bracket 38 secured to the vertical portion 39 of the base bracket 33 by screws 40. The carrier bracket 38 has a vertical track 41 machined therewithin which is positioned centrally below the axle housing 11. A slider block 42 is slidably maintained within the track 41 and is adapted for limited vertical movement by an elongate slot 43 through the block 42, which is parallel to the sides 44,45 of the track 41. A screw 46 passes through the elongate slot 43 and is threadably received in the bracket 38. The screw 46 thus serves to keep the block 42 and bracket 38 together and to limit vertical movement of the block 42 within the track 41. The topmost end 47 of the block 42 has a pivot screw 48 passing through both the slider block 42 and a pivot block 49, and the screw 48 is captivated by lock nuts 50 and tightened to such position that the pivot block 49 may rock, or pivot, slightly about the pivot screw 48 and a machined edge 51 on the slider block 42 serves to limit the pivot movement of the pivot block 49. The pivot block 49 is generally rectangular, having a relieved portion 52 so that it will tend to generally conform to the arcuate shape of the tooling diameter 14 on the housing 11. A pair of rollers 53 are adapted to the pivot block 49 and straddle the tooling diameter 14. The rollers 53 are captivated in the pivot block 49 by threaded studs 54 passing through the roller 53 and block 49 wherein the studs 54 have lock nuts 55 applied to prevent axial movement of the rollers 53 relative to the block 49. As the housing 11 is rotated, therefore, it may be seen that the tooling diameter 14 will cause the rollers 53 to roll, as they are urged into frictional contact with the tooling diameter 14 by a biasing spring 56 located within the track 41 of the bracket 38, immediately beneath the slider block 42. A bottom plate 57 is secured to the bracket 38 by screws 58, so as to form a bottom end to the track 41, and provide a reaction element for the biasing spring 56. The biasing spring 56 consists of a helical compression spring which has one end 59 partially seated in a blind hole 60 in the bottom 61 of the slider block 42, and having its opposite end 62 reacting against a plain washer 63 which is seated on the end 64 of a dog point screw 65 threadably received through the bottom plate 57. The screw 65 is adjusted to vary the compressive force on the spring 56, and may thereafter be secured by a lock nut 66 against the bottom plate 57. In practice, therefore, it may be seen that the spring load may be varied against the slider block 42, and the slider block 42 "floats" under the force of the spring 56 in the track 41, urging the rollers 53 against the tooling diameter 14 during the grinding process. Thereafter, when the axle housing 11 is lifted from the machine 10, the rollers 53 will ascend to a slightly higher point, travel being limited by the screw 46 and the elongate slot 43.

The side elevation shown in FIG. 5 serves to further illustrate the interaction of the elements of the floating support 24, illustrating that the base bracket 33 is held by two clamps 36 to the machine table 16, and the carrier bracket 38 is shown secured to the base bracket 33 and having the slider block 42 received within the carrier bracket track 41. The biasing spring 56 is shown urging the slider block 42 upward, urging the rollers 53 into contact with the tooling diameter 14 of the housing 11 (shown in phantom).

It may be appreciated that while the slider block 42 has been depicted as moving in a substantially vertical direction, modification of the approach angle can be made within the spirit of this invention to obtain vertical force components to react against the sag tendency of the axle housing 11.

Test Results

A substantially similar group of parts was tested, i.e., maximum grind diameter approximately 4 inches; minimum grind diameter approximately $2\frac{5}{8}$ inches; grind length approximately 8 inches. It was found that on parts which were unbraced and simply-supported, the total indicator reading (TIR) for out-of-roundness, varied from 0.0005 to 0.0015 inches on the large grind diameter, and the TIR on the small grind diameter was approximately 40% better. With the parts braced with the prior art device, the TIR varied from 0.0004 to 0.001 inches on the large grind diameter. Here it should be noted that when the process sheets were prepared for the workpiece, it was estimated that two rotational headstock speeds would be required, 80 RPM during coarse grinding and 40 RPM during finish grinding. The actual speed used was a constant 65 RPM because various headstock speeds were tried to improve the out-of-roundness condition, to no avail.

A second test set-up was tried on workpieces which were unbraced, but which were provided with the floating support described herein to minimize the effects of the housing sag tendency. Coarse and finish headstock speeds were 100 RPM and 75 RPM, respectively. The maximum out-of-roundness seen was 0.0003 inch. The majority of parts ran 0.00015 inch on the small grind diameter and 0.0002 to 0.0003 inch on the large grind diameter. It may be noted that, as workpieces vary, the exact amount of force set on the tunable biasing spring is adjustable to obtain the best roundness. When the correct force is established for a given size part, the force-roundness relationship stays consistent over the given lot of workpieces.

It is not intended to limit the invention to the specific embodiment shown herein, but rather it is intended that the invention covers all such modifications as come within the scope of the appended claims.

What is claimed is:

1. A method of grinding a vehicle rear axle housing, comprising the following steps:

(a) supporting both ends of the housing in axial and radial directions;

(b) rotating the housing from one end;

(c) grinding one of opposite end grind diameters with a rotating grinding wheel; and (d) supporting inboard tooling diameters with resilient floating support means substantially opposing gravitational sag of said housing while grinding.

2. The method of claim 1, further comprising the following steps:

(e) reversing the position of said housing on said floating support means, end-for-end; and (f) repeating steps (a) through (d).

3. A method of grinding a vehicle rear axle housing, comprising the following steps:

(a) supporting both ends of the housing in axial and radial directions;

(b) rotating the housing from one end at a first rotational speed;

(c) rough grinding one of opposite end grind diameters at said first speed with a rotating grinding wheel;

(d) rotating the housing from said end at a second, slower speed;

(e) finish grinding the same diameter at said second speed with a rotating grinding wheel; and (f) supporting inboard tooling diameters with resilient floating support means substantially opposing gravitational sag of said housing while grinding.

4. The method of claim 3, further comprising the following steps:

(g) reversing the position of said axle on said floating support means, end-for-end; and (h) repeating steps (a) through (f).

5. A method of grinding a vehicle rear axle housing, comprising the following steps:

(a) supporting both ends of the housing in axial and radial directions;

(b) rotating the housing from one end;

(c) grinding one of opposite end grind diameters with a rotating grinding wheel; and (d) supporting inboard tooling diameters with independent resilient floating support means substantially opposing gravitational sag of said housing while grinding.

6. A method of grinding a vehicle rear axle housing, comprising the following steps:

(a) supporting both ends of the housing in axial and radial directions;

(b) rotating the housing from one end at a first rotational speed;

(c) rough grinding one of opposite end grind diameters at said first speed with a rotating grinding wheel;

(d) rotating the housing from said end at a second, slower speed;

(e) finish grinding the same diameter at said second speed with a rotating grinding wheel; and (f) supporting inboard tooling diameters with independent resilient floating support means substantially opposing gravitational sag of said housing while grinding.

* * * * *